US006105939A

United States Patent [19]

Vance et al.

[11] Patent Number: 6,105,939

[45] Date of Patent: Aug. 22, 2000

[54] STUFFING BOX SHEAVE ASSEMBLY WITH RETENTION PAD

[75] Inventors: Russell L. Vance, West Jordan; Derek D. Carlson, Bountiful, both of Utah

[73] Assignee: Wireline Technologies, Inc., North Salt Lake, Utah

[21] Appl. No.: 09/054,841

[22] Filed: Apr. 3, 1998

[51] Int. Cl.[7] ..... B66D 3/04

[52] U.S. Cl. ..... 254/405; 254/411; 254/415

[58] Field of Search ..... 254/415, 405, 254/403, 408, 411

[56] References Cited

U.S. PATENT DOCUMENTS

| | | | |
|---|---|---|---|
| 2,283,048 | 5/1942 | Collett, Jr. | 254/415 |
| 3,104,094 | 9/1963 | Liem et al. | 254/415 |
| 3,171,633 | 3/1965 | Le Bus, Jr. et al. | 254/415 |
| 3,292,908 | 12/1966 | Thompson | 254/415 |
| 3,385,563 | 5/1968 | Stinson, Jr. | 254/415 |
| 4,301,995 | 11/1981 | Niskin | 254/411 |
| 4,480,818 | 11/1984 | Frank | 254/411 |
| 5,186,283 | 2/1993 | Salmon | 254/333 |
| 5,645,269 | 7/1997 | Peterson | 254/393 |

*Primary Examiner*—Katherine A. Matecki
*Attorney, Agent, or Firm*—Madson & Metcalf

[57] ABSTRACT

A stuffing box sheave assembly includes a brace having a tubular collar positioned at one end and a pair of spaced apart forked arms outwardly projecting from the opposing end. A nylon wheel is rotatably mounted between the forked arms. The wheel has an annular grooved recessed around the circumference thereof. The groove is configured to receive a wireline. An arcuate shroud is positioned over a portion of the circumference of the wheel. A pair of spaced apart retention pads are mounted to the shroud. Each of the pads are configured to be received within the groove of the wheel so as to prevent accidental jumping of the wireline out of the groove. A pair of tubular posts project from opposing sides of the shroud and are selectively received within the channel of a tubular member upwardly projecting from each forked arm.

20 Claims, 4 Drawing Sheets

STUFFING BOX SHEAVE ASSEMBLY WITH RETENTION PAD

BACKGROUND OF THE INVENTION

1. The Field of the Invention

The present invention relates to sheave assemblies, and more specifically stuffing box sheave assemblies used on oil and gas wells.

2. Present State of the Art

Wells, such as gas wells, oil wells, and water wells, are created by drilling a deep, narrow hole in the ground and then cementing or otherwise securing a hollow, tubular casing within the hole. The well head is the portion of the casing exposed above the ground surface. A pump or valve is attached to the well head to control the flow of fluid or gas from the well. A stuffing box is typically positioned at the top exposed end of the well head. The stuffing box functions to selectively seal the mouth of the well head. Specifically, the stuffing box operates to produce a seal around objects such as pumping rod or wireline, as discussed below, that are lowered through the mouth of the well head and into the casing.

It is frequently desired to run various types of tooling down the casing. Such tooling can include cameras, vibrators, explosives, various sound generators, and equipment for cleaning the interior of the casing. To facilitate lowering of the tooling within the casing, a wireline is used. The wireline must be able to withstand the highly corrosive environment that is commonly encountered within conventional gas and oil wells. Furthermore, the wireline must be sufficiently strong to withstand the tensile force placed on the wireline when the tooling is lowered hundreds and even thousands of feet within the casing. In addition, the type of wireline used is also dependent upon the type of tooling used. For example, some toolings requires that the wireline carry an electrical current for powering or sending signals back from the tooling.

Due to the above requirements, the wireline can be extremely expensive, even up to several dollars a foot. Most wireline is comprised of stainless steel or other non-corrosive metal. Examples of conventional wireline include coaxial cable, E-line which is an armor cable with one or more conductive lines on the inside, and slick line which is a solid line often made of carbon steel.

During operation, a large continuous spool of wireline is brought to the well site. Although the wireline is relatively flexible, the wireline must be feed into the casing in such a fashion as to avoid kinking the wireline. Kinking can potentially damage or break the wireline. Furthermore, the wireline must facilitate smooth and easy lowering and raising of the tooling within the casing.

To accomplish the above objectives, a lower sheave or pulley is secured near the base of the exposed well head at a position substantially level with the spool of wireline. A stuffing box sheave assembly is attached to the elevated stuffing box. Both of the sheaves include a freely rotatable wheel having a groove formed around the circumference thereof. The groove is configured to receive and retain the wireline. The wireline is drawn around the wheel of the lower sheave and then drawn over the wheel of the stuffing box sheave assembly. The wireline is laid within the groove of the wheels to prevent the wireline from sliding off the wheels. The free end of the wireline is attached to the tooling which is then lowered down into the casing.

Although the sheave assemblies serve a desired function, they have several shortcomings. For example, there are frequent occurrences in which the tooling may accidentally get caught or momentarily stop as it travels down the casing. At these times, slack is produced in the wireline. This slack can cause the wireline to jump out of the groove on the wheel of the stuffing box sheave assembly. Should the tooling then drop, the wireline and sheave assembly can be both badly damaged. On occasion, jumping of the wireline off of the sheave wheel can result in wireline breaking, thereby causing the tooling to freely fall to the bottom of the well. Not only is it extremely expensive to repair broken wireline, but there is extensive down time and expense in fishing the tooling from the bottom of the well. Furthermore, jumping and/or breaking of the wireline creates a hazard to the surrounding workers that are lowering the tooling.

Another problem with conventional sheave assemblies is that the wheel is made out of metal. Since the wheel and wireline are both metal, the engagement therebetween produces a relatively high wear rate on both of the elements. Furthermore, since the metal wheel does not flex or give, the smaller wireline compresses against the weight of the tooling as the wireline passes over the wheel of the stuffing box sheave assembly. Repeated compression and expansion of the wireline results in fatigue and subsequently failure to the wireline.

OBJECTS AND BRIEF SUMMARY OF THE INVENTION

Accordingly, it is an object of the present invention to provide improved sheave assemblies.

Another object of the present invention is to provide improved sheave assemblies which minimize the potential of the wireline jumping off of the wheel and thus minimize the potential damages and down time associated therewith.

Yet another object of the present invention is to provide improved sheave assemblies which minimize the wear on both the wheel and the wireline.

Finally, another object of the present invention is to provide sheave assemblies which minimize fatigue on the wireline.

To achieve the foregoing objects, and in accordance with the invention as embodied and broadly described herein, a sheave assembly is provided. The sheave assembly includes a substantially L-shaped brace having a tubular collar positioned at one end and a pair of forked arms outwardly projecting from the opposing end. The tubular collar has a passageway extending therethrough. The passageway is configured to receive the hollow stem of a stuffing box mounted on a well head.

A nylon wheel is rotatably mounted between the forked arms of the brace. The wheel has an annular groove recessed around the circumference thereof The groove is configured to receive a wireline. An arcuate shroud is positioned over a portion of the circumference of the wheel. A pair of spaced apart retention pads are adjustably mounted to the inside surface of the shroud. Each of the retention pads has a tapered end that is configured to be received within the groove of the wheel so as to prevent the wireline from accidentally jumping out of the groove.

A pair of posts downwardly project from opposing sides of the shroud. Each of the posts are slidably received within the channel of a tubular member upwardly projecting from each of the forked arms. By lowering the posts into the channels, the retention pads are received within the wheel groove for retaining the wireline therein. By raising the shroud, at least one of the posts is separated from the corresponding channel, thereby enabling the wireline to be selectively laid over or removed from the wheel.

The present invention has several unique advantages over prior art sheave assemblies. Most notably, as a result of the retention pads being received within the grooves of the wheel, the potential for the wireline accidentally jumping out of the wheel groove is substantially minimized. As a result, the cost, delay, and potential danger associated with jumping of the wireline is also minimized.

Fabricating the wheel out of nylon also has several advantages. For example, the nylon wheel is softer and more compressible then a conventional metal wheel. As a result, the wear between the wheel and wireline is minimized, thereby extending the life of both the wheel and the wireline. Furthermore, the wheel rather than the wireline is compressed during operation. Accordingly, fatigue on the wireline is also minimized.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
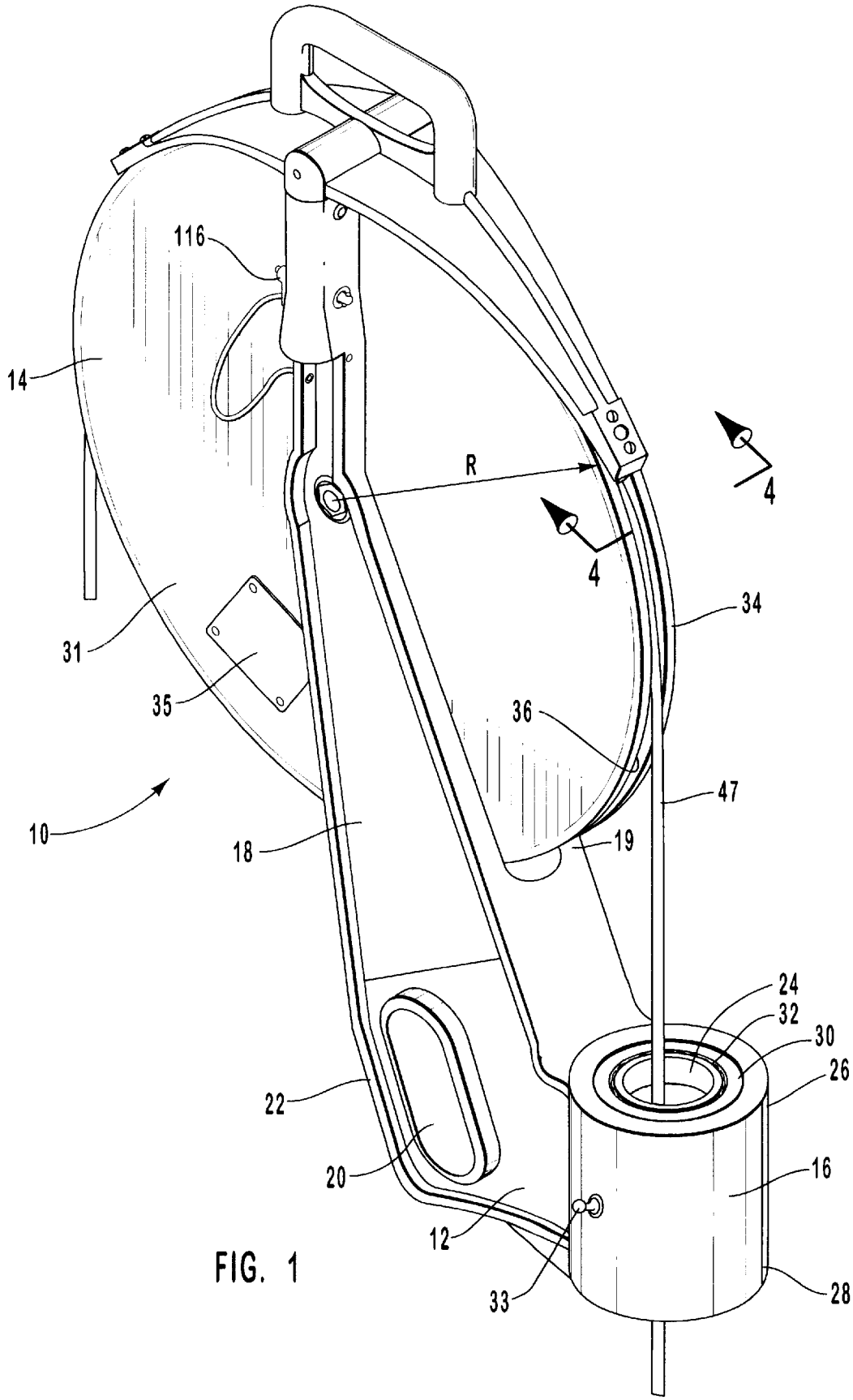
FIG. 1 is a perspective view of an inventive sheave assembly.

Depicted in FIG. 1 is one embodiment of a stuffing box sheave assembly 10 incorporating features of the present invention. Sheave assembly 10 comprises a brace 12 having a wheel 14 rotatably attached thereto. Brace 12 has a substantially L-shaped configuration with a tubular collar 16 mounted at one end and a pair of spaced apart forked arms 18 and 19 projecting from an opposing end. Transversely extending through brace 12 between the opposing ends is an opening 20. Opening 20 forms a handle portion 22 for holding sheave assembly 10.

Figure 2:
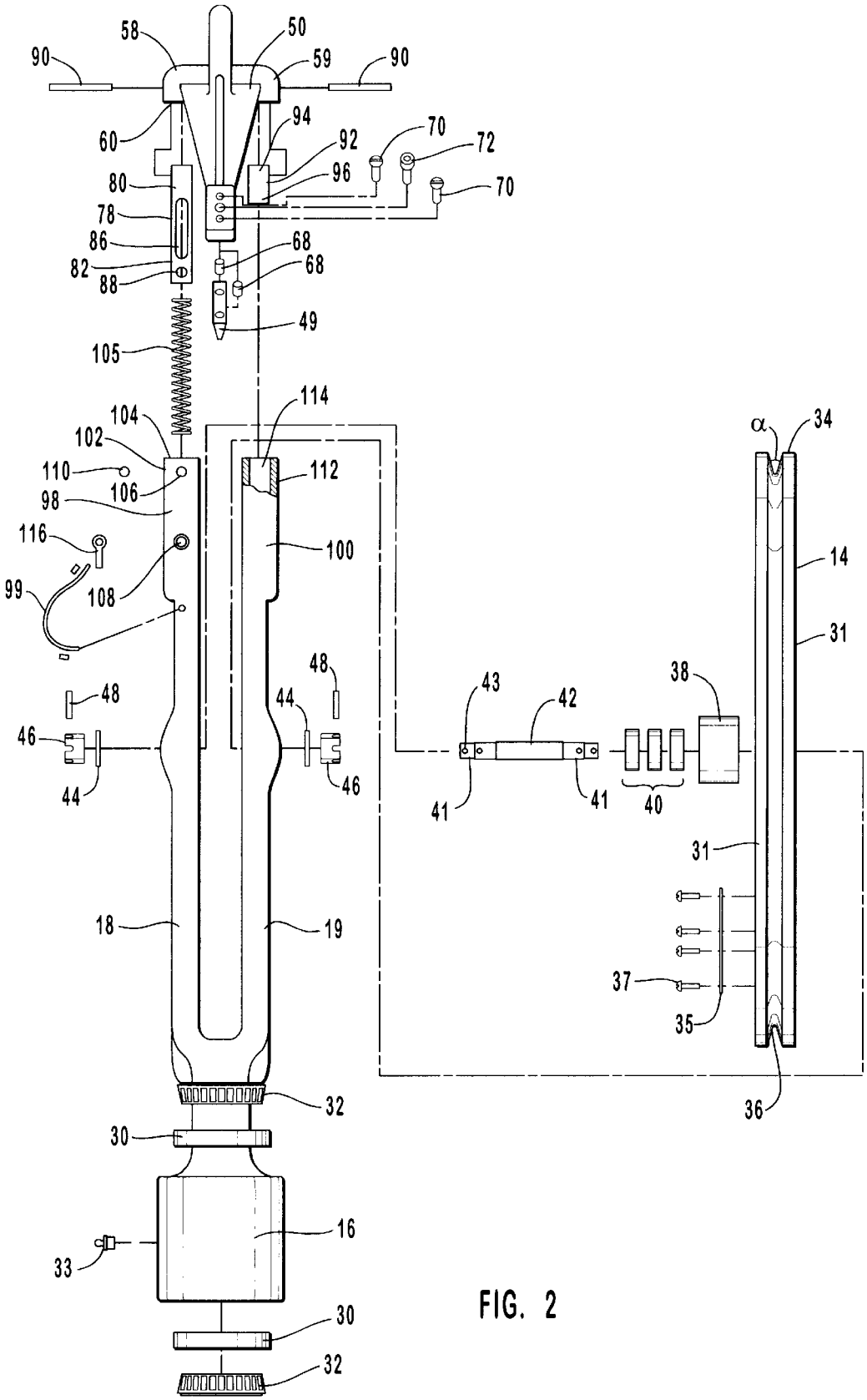
FIG. 2 is a front view of the sheave assembly shown in FIG. 1 in a dissembled condition.

Depicted in FIGS. 1 and 2, collar 16 has a passageway 24 longitudinally extending from a top end 26 to a bottom end 28. Seated within each opposing end of passageway 24 is an annular bearing cup 30. Likewise, positioned within each bearing cup 30 is an annular bearing cone 32. An opening extends through each of bearing cups 30 and bearing cones 32 so that passageway 24 freely passes through collar 16 when bearing cups 30 and bearing cones 32 are received therein.

Although not depicted, passageway 24 of collar 16 is configured to receive the hollow stem a stuffing box mounted on a well head. A passageway extending through the stuffing box stem is axially aligned and communicates with the interior of the well casing. The stem of the stuffing box is received with passageway 24 so that bearing cones 32 ride against the sides of the stuffing box stem. As a result, sheave assembly 10 can freely spin around the stuffing box stem. A grease plug 33 is mounted on collar 16 and is configured for feeding grease to passageway 24.

In one embodiment, brace 12 is cast from aluminum. In alternative embodiments, brace 12 can be made from other materials using different processes.

Figure 4:
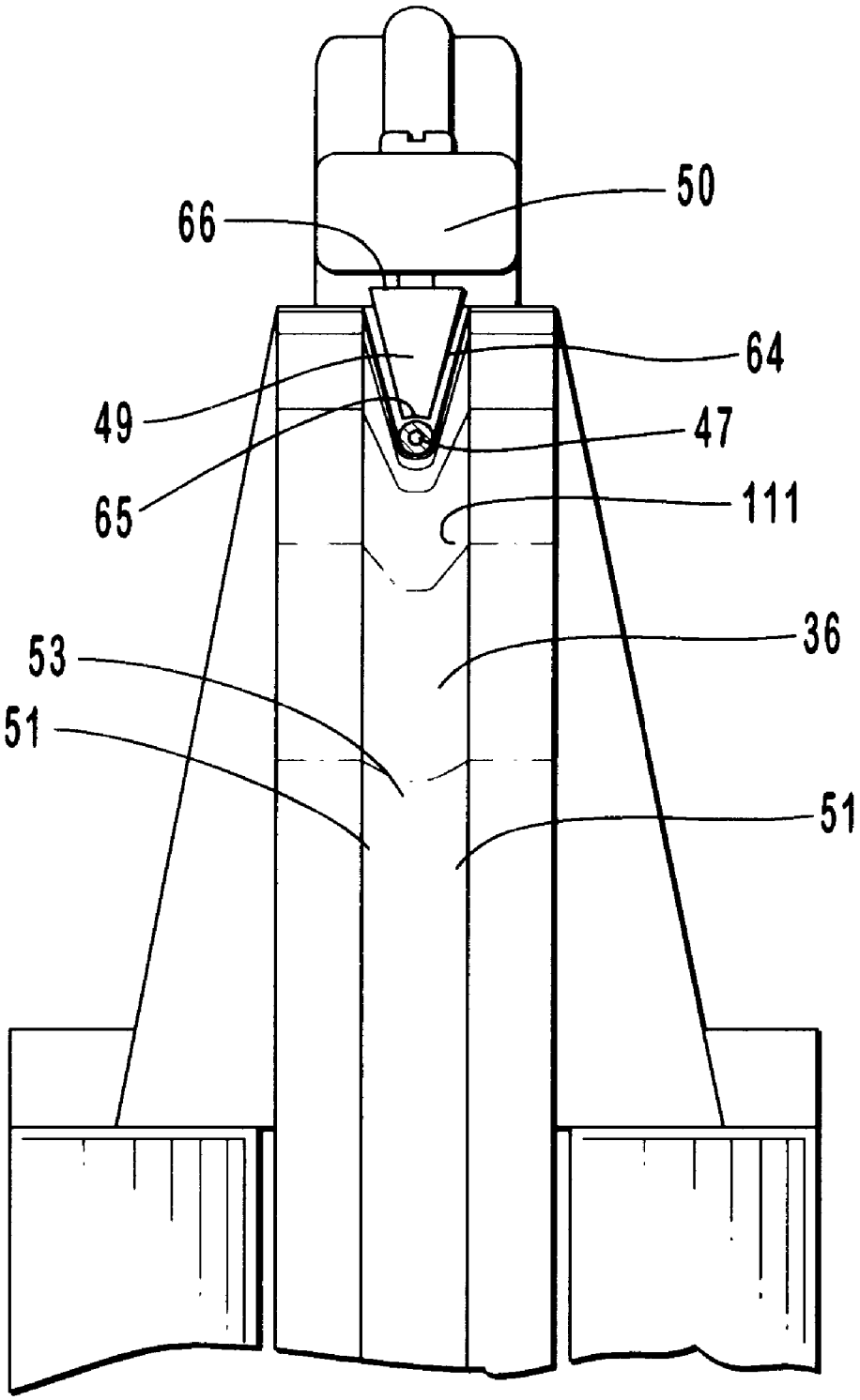
FIG. 4 is a side view of the retention pad shown in FIG. 1 taken along sections lines 4—4.

As depicted in FIGS. 1 and 2, wheel 14 has opposing sidewalls 31 extending to an outer face 34 positioned at the circumference thereof. Wheel 14 has a radius R in a range between about 4 inches to about 12 inches with about 8 inches to about 10 inches being preferred. An annular groove 36 is recessed within outer face 34 and is configured to receive a wireline 47. As depicted in FIGS. 2 and 4, groove 36 has a substantially V-shaped transverse cross section. Groove 36 is comprised of sloping sidewalls 51 that intersect at a floor 53. The inside angle a between sidewalls 51 is in a range between about 20° to about 60° with about 20° to about 40° being preferred and about 25° to about 35° being more preferred. Floor 53 is also rounded so as to have a radius in a range between about the radius of wireline 47 to about 10% greater then the radius of wireline 47. Wireline 47 typically has a diameter in a range between about 0.09 inches to about 0.65 inches.

In one embodiment, wheel 14 is made of plastic and more preferably nylon. A lubricant, such as molybdenum disulfide, can be combined with the plastic. One example of a nylon material is NYLATRON® available from DSM Engineering Plastics Production, Inc. out of Reading, Pa. In alternative embodiments, wheel 14 can also be made out of other materials such as metals or composites.

In one embodiment, wheel 14 is mounted on brace 12 such that when a load in a range between about 500 pounds to about 700 pounds and more preferably about 600 pounds is applied to wireline 47, wireline 47 becomes concentrically aligned with passageway 24 extending through collar 16.

If desired, an identification plate 35 can be mounted to sidewall 31 of wheel 14 by screws 37. Press fit within the central axis of wheel 14 is a hub 38. Received within hub 38 are a plurality of sealed radial ball bearings 40. In this configuration, wheel 14 is disposed between forked arms 18 and 19. An axle shaft 42 is used to secure wheel 14 to forked arms 18 and 19.

Axle shaft 42 has opposing threaded ends 41 each having at least one hole 43 extending therethrough. Axle shaft 42 is passed through forked arms 18, 19, and bearings 40 such that opposing ends 41 outwardly project from each forked arm 18 and 19. A washer 44 is slid over each exposed end 41 after which a slotted nut 46 is screwed onto each end 41, thereby securing wheel 14 between forked arms 18 and 19. Finally, pins 48 are passed through slotted nuts 46 and holes 43 in axle 42, thereby preventing accidental loosening of slotted nuts 46.

Figure 3:
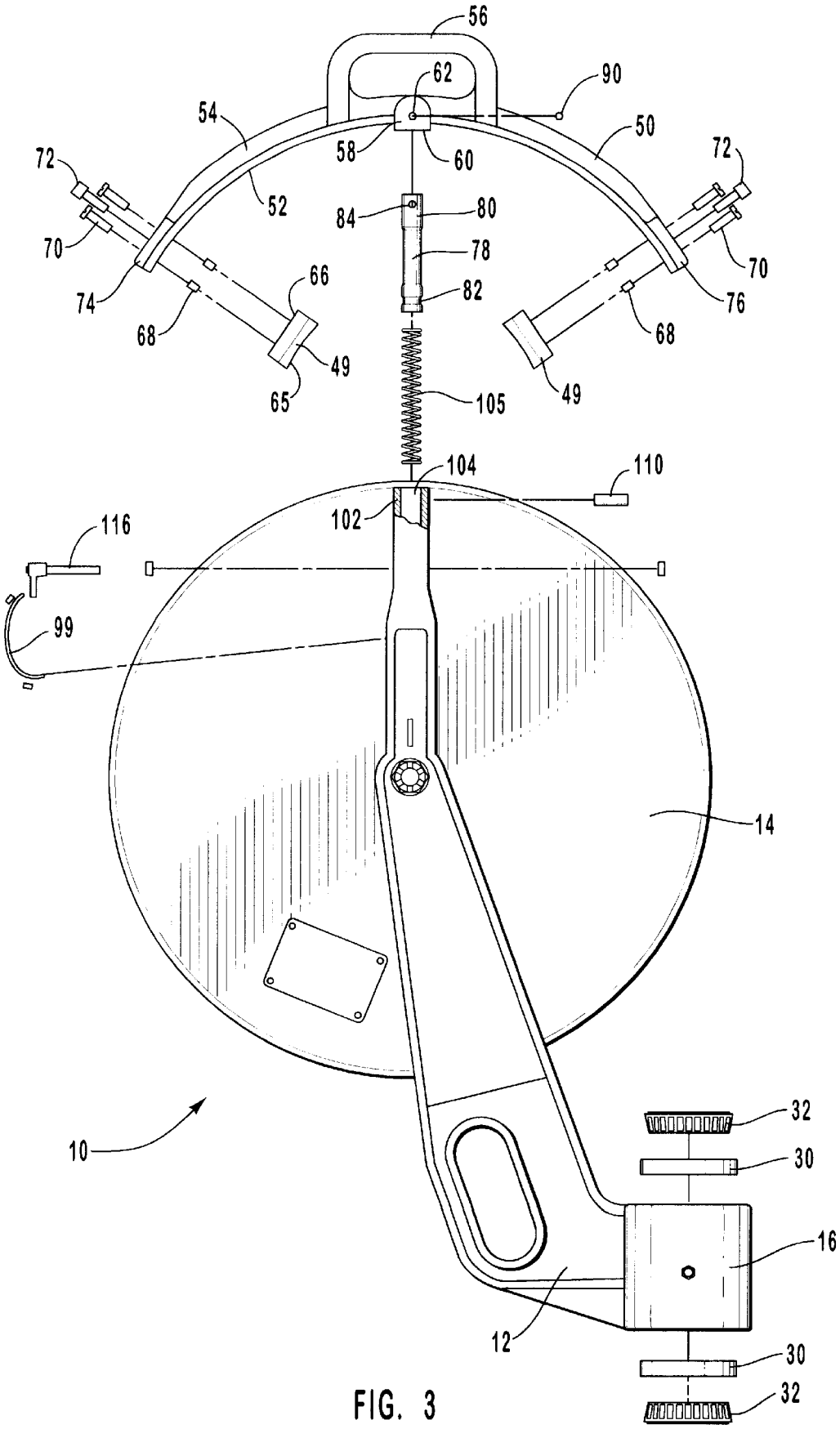
FIG. 3 is a side view of the sheave assembly shown in FIG. 1 in a partially disassembled condition.

As depicted in FIGS. 2 and 3 and discussed later in greater detail, sheave assembly 10 also includes a pair of spaced apart retention pads 49. Each retention pad 49 is configured to be received within groove 36.

In one embodiment of the present invention, means are provided for selectively moving a retention pad 49 between a first position when retention pad 49 is at least partially received within groove 36 of wheel 14 so that wheel 14 and retention pad 49 substantially surround a portion of wireline 47 received within groove 36. The means also functions to move the retention pad 49 to a second position wherein the retention pad 49 is withdrawn from groove 36 so as to enable wireline 47 to be freely laid within or removed from groove 36.

By way of example and not by limitation, sheave assembly 10 further includes an arcuate shroud 50 having an interior surface 52 and an exterior surface 54 each extending between opposing ends 74 and 76. Interior surface 52 longitudinally curves at a radius substantially complementary to the radius of wheel 14. As depicted in FIGS. 3 and 4, each retention pad 49 has a pair of inwardly tapered sidewalls 64 extending between an inner surface 65 and an outer surface 66. In a plane transverse to the longitudinal axis of retention pad 49, inner surface 65 can be flat or coved complementary to the radius of wireline 47. In a plane parallel to the longitudinal axis of retention pad 49, inner surface 65 has a radius substantially complementary to the radius of wheel 14. Sidewalls 64 of retention pad 49 are oriented substantially complementary to sidewalls 51 of groove 36. Accordingly, sidewalls 64 and 51 are substantially parallel when retention pad 49 is received within groove 36.

A pair of threaded inserts 68 are secured within outer surface 66 of each retention pad 49. Screws 70 are then pass through opposing ends of shroud 50 and threadedly engaged with inserts 68. A set screw 72 passes through and threadedly engages shroud 50 between screws 70. The end of set screw 72 biases against outer surface 66 of retention pad 49. Accordingly, screws 70 function to withdraw retention pad 49 toward shroud 50 while set screws 72 function to push retention pad 49 away therefrom. By adjusting the various screws 70 and 72, pad 49 can be positioned relative to shroud 50 so as to be selectively positioned within groove 36.

In one embodiment, retention pad 49 is comprised of a plastic, rubber, or an elastomer. One preferred type of plastics are the ultra high molecular weight plastics. One example of a material for retention pad 49 is UHMW available from Laird Plastics out of Salt Lake City, Utah.

As depicted in FIGS. 2 and 3, outwardly projecting from exterior surface 54 of shroud 50 is a handle 56. Positioned on each opposing side of handle 56 is a mounting dome 58 and 59. Each mounting dome 58 and 59 has a retention chamber 60 recessed therein from interior surface 52. A pin hole 62 also extends to each retention chamber 60 from the side of each mounting dome 58 and 59.

Configured for mounting with mounting dome 58 is an elongated post 78. Elongated post 78 extends from a first end 80 to an opposing second end 82. A first aperture 84 extends through the side of post 78 at first end 80. Like wise a second aperture 88 extends through the side of post 78 at second end 82. A narrow slot 86 longitudinally extends through post 78 between apertures 84 and 88. First end 80 of post 78 is received within retention chamber 60 of mounting dome 58. A pin 90 is then passed through pin hole 62 and first aperture 84 so as to secure post 78 therein. The present invention also envisions that welding, adhesives or other conventional latching means can be used to secure post 78 within mounting dome 58.

A short post 92 extends between a first end 94 and an opposing second end 96. Short post 92 has a length shorter than elongated post 78. Short post 92 also has a first aperture 84 formed in a first end 94 thereof. First end 94 is configured to be captured within mounting dome 59 in the same way that elongated post 78 is attached to mounting dome 58.

Upwardly extending from forked arm 18 is a tubular member 98. Tubular member 98 terminates at a free end 102 and has a channel 104 recessed therein. Channel 104 is configured to slidably receive post 78. A first pin hole 106 and a second pin hole 108 are spaced apart and both transversely extend through tubular member 98.

During assembly, a spring 105 is initially received within channel 104. Next, second end 82 of elongated post 78 is received within channel 104. Post 78 is advanced within channel 104 until fist pin hole 106 is aligned with slot 86. A pin 110 is then passed through first pin hole 106 and slot 86, thereby slidably securing post 78 within channel 104.

A tubular member 100 also upwardly extends from forked arm 19. Tubular member 100 terminates at a free end 112 and has a channel 114 recessed therein. Channel 114 is configured to slidably receive short post 92.

In this assembled condition, shroud 50 can move between a first and second position. In the first position, short post 92 is received within channel 114 and elongated post 78 is received within channel 104. Elongated post 78 is advanced, thereby compressing spring 105, until second aperture 88 on post 78 is aligned with second pin hole 108. In this first position, a locking pin 116 is inserted into second pin hole 108 and second aperture 88, thereby securing shroud 50 adjacent to wheel 14. Locking pin 116 is secured to forked arm 18 by a tether 99.

As depicted in FIG. 4, in the first position retention pads 49 are received within groove 36 so that inner surface 65 of each retention pad 49 is adjacent to wireline 47. Furthermore, each retention pad 49 is positioned and configured so that the distance between sidewalls 64 of retention pads 49 and sidewalls 51 of groove 36 is smaller than the diameter of wireline 47, preferably smaller than about 0.05 inches, and more preferably smaller than about 0.01 inches.

As a result of groove 36 and retention pad 49 substantially enclosing wireline 47, it is virtually impossible for wireline 47 to jump out of groove 36. Furthermore, as a result of posts 78 and 92 being received within their corresponding tubular members 98 and 100, even if wireline 47 was able to slip by retention pad 49, posts 78 and 92 would prevent wireline 47 from completely separating from sheave assembly 10.

Although one or more retention pads 49 can be positioned at any location on shroud 50, there are benefits to positioning retention pads 49 at opposing ends of shroud 50. Typically, if wireline 47 is going to jump from groove 36, it will begin to separate or become misaligned with groove 36 at the point where wireline 47 leaves contact with wheel 14. Accordingly, positioning retention pads 49 adjacent to each of the locations where wireline 47 separates from wheel 14 maximizes the ability to prevent jumping of wireline 47 from groove 36.

To move retention pads 49 to the second position, locking pin 116 is removed from second pin hole 108 which allows spring 105 to automatically raise post 78 and thus shroud 50. Simultaneously, retention pads 49 are lifted up and out of groove 36. Post 78 remains engaged within channel 104 as a result of pin 110. However, since post 92 is shorter than post 78, post 92 separates from tubular member 100. Accordingly, in the second position wireline 47 can be passed between post 92 and tubular member 100 for either laying wireline 47 within groove 36 or removing it therefrom.

The above discussed embodiment provides a unique structure for easily, quickly and safely moving retention pads 49 between the first position for capturing wireline 47 and the second position for allowing wireline 47 to be disposed on or removed from wheel 14. The present invention envisions that there are a variety of alternative designs and modifications that could be made to perform the same function. For example, the posts and tubular members can be reversed or altered in configuration. They can also be replaced with members that simply slide against each other or otherwise couple together.

Furthermore, there area variety of alternative means for simply supporting the retention pad at least partially within the groove of the wheel such that the retention pad does not directly contact the wheel. In addition to the above discussed examples, either U or L shaped brackets can have a retention pad 49 mounted thereon so that when the bracket is bolted or otherwise removably secure to forked arms 18 and/or 19, or other sections of brace 12, retention pad 49 is received within groove 36.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A sheave assembly for operation with a wireline, comprising:

(a) a brace;

(b) a wheel rotatably mounted to the brace, the wheel having an annular groove recessed around the circumference thereof, the groove being configured to receive the wireline;

(c) a retention pad configured to be received within the groove of the wheel; and (d) means for supporting the retention pad at least partially within the groove of the wheel such that the retention pad does not directly contact the wheel.

2. A sheave assembly as recited in 1, wherein the brace comprises a pair of forked arms having the wheel rotatably mounted therebetween.

3. A sheave assembly as recited in 2, wherein the means for supporting comprises an arcuate shroud positioned over a portion of the groove on the wheel, the shroud having an interior surface on which the retention pad is mounted.

4. A sheave assembly as recited in 3, wherein the means for supporting further comprises:

(a) a post downwardly projecting from each opposing side of the shroud; and (b) a tubular member projecting from each of the forked arms and having a channel formed in the end thereof, each channel being configured to slidably receive a corresponding post.

5. A sheave assembly as recited in 4, wherein the posts projecting from the shroud are different lengths.

6. A sheave assembly as recited in 3, further comprising a second retention pad configured to be received within the groove of the wheel.

7. A sheave assembly as recited in 6, wherein the retention pads are spaced apart and are mounted on the interior surface of the shroud.

8. A sheave assembly as recited in 1, wherein the wheel is comprised of plastic.

9. A sheave assembly as recited in claim 1, wherein the means for supporting comprises means mounted to the brace for selectively moving the retention pad between:

(i) a first position wherein the retention pad is at least partially received within the groove of the wheel so that the wheel and retention pad substantially surround a portion of the wireline received within the groove; and (ii) a second position wherein the retention pad is withdrawn from the groove so as to enable the wireline to be freely laid within or removed from the groove.

10. A sheave assembly for operation with a wireline, comprising:

(a) a brace having a collar positioned at one end, the collar having a passageway extending therethrough, and a pair of spaced apart forked arms outwardly projecting from the opposing end;

(b) a wheel rotatably mounted between the forked arms, the wheel having an annular groove recessed around the circumference thereof, the groove being configured to receive the wireline;

(c) a shroud positioned over a portion of the circumference of the wheel and mounted to at least one of the forked arms; and (d) a retention pad mounted to the shroud and having a tapered end received within the groove of the wheel so as to substantially capture a portion of the wireline within the groove.

11. A sheave assembly as recited in claim 10, wherein the retention pad has sidewalls and the distance between the sidewalls of the retention pad and the surface of the groove is less than about 0.05 inches.

12. A sheave assembly as recited in claim 10, wherein the wheel is comprised of nylon.

13. A sheave assembly as recited in claim 10, wherein the wheel has a radius in a range between about 8 inches to about 12 inches.

14. A sheave assembly as recited in claim 10, wherein the groove in the wheel has a substantially V-shaped transverse cross-section with an inside angle in a range between about 25° to about 35°.

15. A sheave assembly as recited in claim 10, wherein the groove has tapered sidewalls and the retention pad has tapered sidewalls, the sidewalls of the groove and the retention pad being oriented at complementary angles.

16. A sheave assembly as recited in claim 10, further comprising a second retention pad configured to be received within the groove of the wheel.

17. A sheave assembly as recited in claim 16, wherein the retention pads are spaced apart and are adjustably mounted on an interior surface of the shroud.

18. A sheave assembly as recited in 10, further comprising:

(a) a post downwardly projecting from each opposing side of the shroud; and (b) a tubular member projecting from each of the forked arms and having a channel formed in the end thereof, each channel being configured to slidably receive a corresponding post.

19. A sheave assembly for operation with a wireline, comprising:

(a) a brace having a collar positioned at one end, the collar having a passageway extending therethrough, and a pair of spaced apart forked arms outwardly projecting from the opposing end;

(b) a wheel rotatably mounted between the forked arms, the wheel having an annular groove recessed around the circumference thereof, the groove being configured to receive the wireline;

(c) an arcuate shroud positioned over a portion of the circumference of the wheel;

(d) a pair of spaced apart retention pads mounted to the shroud, each of the retention pads being configured to be received within the groove of the wheel; and (e) means for securing the shroud to the fork arms so that the retention pads are received within the groove of the wheel.

20. A sheave assembly as recited in 19, wherein the means for securing comprises:

(a) a post downwardly projecting from each opposing side of the shroud; and (b) a tubular member projecting from each of the forked arms and having a channel formed in the end thereof, each channel being configured to slidably receive a corresponding post.

* * * * *